US009757941B2

(12) United States Patent
Gracia Verdugo et al.

(10) Patent No.: US 9,757,941 B2
(45) Date of Patent: Sep. 12, 2017

(54) IMAGE CONTENT BASED SPIT BARS

(71) Applicant: HEWLETT-PACKARD DEVELOPMENT COMPANY, L.P., Houston, TX (US)

(72) Inventors: Antonio Gracia Verdugo, Barcelona (ES); Oriol Borrell Avila, Sabadell (ES); Francisco Javier Perez Gellida, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/306,405

(22) PCT Filed: Apr. 29, 2014

(86) PCT No.: PCT/US2014/035828

§ 371 (c)(1),
(2) Date: Oct. 24, 2016

(87) PCT Pub. No.: WO2015/167452

PCT Pub. Date: Nov. 5, 2015

(65) Prior Publication Data

US 2017/0043575 A1 Feb. 16, 2017

(51) Int. Cl.

| | |
|---|---|
| ***B41J 2/21*** | (2006.01) |
| ***B41J 2/045*** | (2006.01) |
| ***B41J 2/165*** | (2006.01) |

(52) U.S. Cl.

CPC ..... *B41J 2/04536* (2013.01); *B41J 2/04586* (2013.01); *B41J 2/16526* (2013.01); *B41J 2/2103* (2013.01); *B41J 2002/1657* (2013.01); *B41J 2002/16529* (2013.01)

(58) Field of Classification Search

CPC ..... B41J 2/04536; B41J 2/04586; B41J 2/16526; B41J 2/2103; B41J 2/2146; B41J 2002/16529; B41J 2002/1657; B41J 2002/21

See application file for complete search history.

(56) References Cited

U.S. PATENT DOCUMENTS

| | | | |
|---|---|---|---|
| 5,236,795 | A | 8/1993 | Berman et al. |
| 5,659,342 | A | 8/1997 | Lund et al. |
| 6,144,024 | A | 11/2000 | Rushing |

(Continued)

FOREIGN PATENT DOCUMENTS

| | | |
|---|---|---|
| JP | 2005096482 | 4/2005 |
| WO | WO-2013095497 | 6/2013 |

OTHER PUBLICATIONS

Epson; Epson Stylus® Pro 7890 and 9890; Dec. 16, 2010; http://www.epson.com/_alfresco/proimaging/products/StylusPro78909890/downloads/7890_9890_brochure_v1.pdf.

*Primary Examiner* — Anh T. N. Vo
(74) *Attorney, Agent, or Firm* — HP Inc.—Patent Department

(57) ABSTRACT

In an embodiment, a method of maintaining nozzles in a print-ready condition includes determining image content to be printed in an upcoming print swath, and for each ink color present within the image content, constructing an inked portion of an associated spit bar adjacent to the upcoming print swath to include the present ink color. For each ink color not present within the image content, an empty portion of an associated spit bar is constructed adjacent to the upcoming print swath.

15 Claims, 6 Drawing Sheets

(56) References Cited

U.S. PATENT DOCUMENTS

| | | | | |
|---|---|---|---|---|
| 7,278,701 | B2 * | 10/2007 | Fagan | B41J 2/17566 347/14 |
| 7,434,911 | B2 * | 10/2008 | Brookmire | B41J 2/2132 347/12 |
| 7,871,145 | B1 * | 1/2011 | Enge | B41J 2/2135 347/14 |
| 9,088,752 | B2 * | 7/2015 | Bhaskaran | H04N 1/6013 |
| 2003/0063151 | A1 | 4/2003 | Bauer | |
| 2005/0214015 | A1 | 9/2005 | Friedrich | |
| 2006/0284922 | A1 | 12/2006 | Beak | |
| 2007/0070095 | A1 | 3/2007 | Baek et al. | |
| 2009/0002413 | A1 | 1/2009 | Choi | |

* cited by examiner

IMAGE CONTENT BASED SPIT BARS

BACKGROUND

Inkjet printing systems form printed images by ejecting print fluids onto various print media. Printheads are controlled to eject individual drops of print fluid from nozzles onto print media at particular locations to form images such as graphics and text on the media. Print fluids can include ink and other fluids, such as treatment fluids that improve the quality and durability of the printed image.

When printhead nozzles sit idle for too long (i.e., without ejecting any print fluids), nozzle issues can develop that cause some nozzles to be in a non-print-ready condition. The continued use of such nozzles can adversely impact print quality. One example of such an issue is clogs that can form in and/or over the nozzles as the print fluid dries. The degree of clogging can depend in part on the type of print fluid being ejected, and the manner by which it is ejected. For example, when exposed to high temperatures such as during ejection from a thermal inkjet printhead, latex inks can form a film on the printhead nozzle plate that results in clogging of the nozzles. Clogged nozzles can block the flow of ink, causing degradation and/or failure of the printhead and reduced overall print quality.

During printing, inkjet printing systems usually implement servicing routines that help to maintain printhead nozzles in a print-ready condition. One servicing routine often used is a process known as "spitting", which involves the periodic ejection of printing fluid drops through the printhead nozzles.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
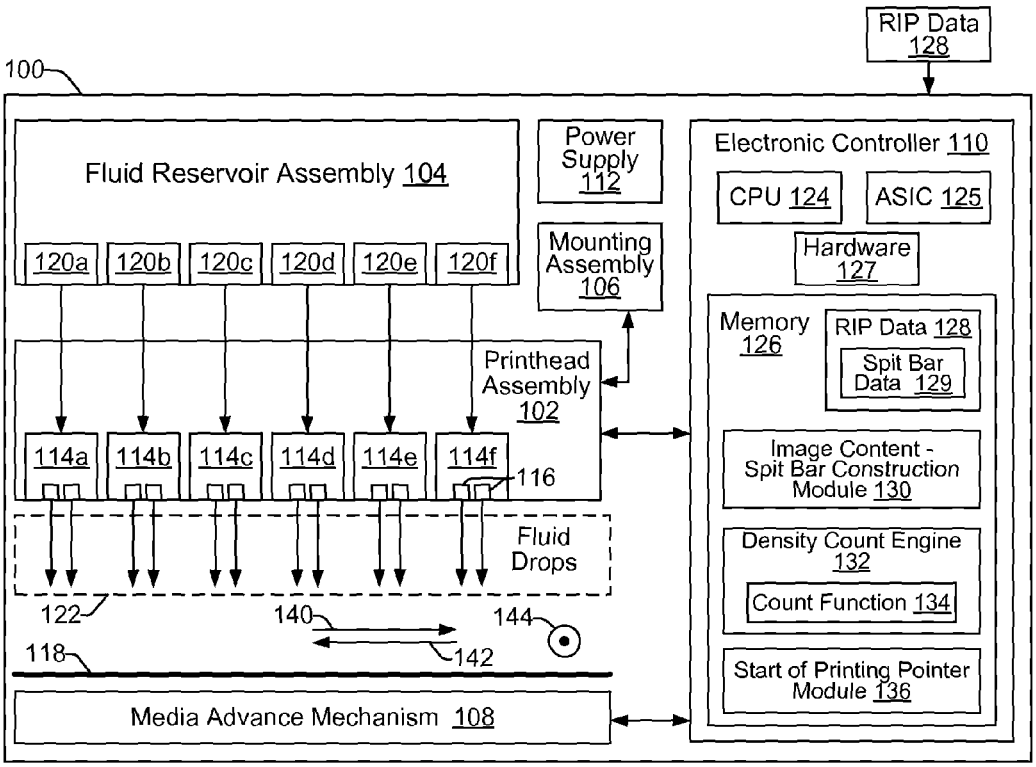
FIG. 1 shows a block diagram of an example inkjet printing system suitable for implementing image content based spitting of print fluid drops into spit bars.

As noted above, inkjet printing systems can help to maintain printhead nozzles in a print-ready condition by spitting print fluid on a periodic basis. In one example, printer servicing routines can control spitting to eject "waste" print fluid drops into a service station reservoir called a spittoon on an inkjet printing device. An alternate or additional method of maintaining printhead nozzles in a print-ready condition includes spitting print fluid drops over the print media in a process referred to as "flying spit". Flying spit involves firing selected printhead nozzles to deposit "image" print fluid drops (i.e., in contrast to "waste" print fluid drops) onto a print media page to print an image. In a purging step, selected nozzles are purged as they are fired to deposit "purging" print fluid drops onto the page. Purging print fluid drops are scattered randomly over the page or in image background areas to prevent compromising the image print quality. Flying spit can include purging inks of different colors as well as transparent print fluids such as pre and post treatment fluids.

In some instances, these methods may not be adequate to maintain printhead nozzles in a print-ready condition at any given time during the printing process. Accordingly, other methods can be used in addition to or instead of those already mentioned. One such method involves spitting (i.e., ejecting) print fluid drops onto the print media at designated areas called "spit bars" located on either side of the image being printed. Spit bars are often provided as print data through an external raster image processor (i.e., a RIP). The color of each spit bar typically corresponds to one of the ink colors of the printing device. For example, where a printing device uses cyan ink, magenta ink, yellow ink, and black ink, four spit bars can be printed on each side of the image with each spit bar corresponding to one of the four colors, cyan, magenta, yellow, and black.

Spit bars can be used to help maintain printhead nozzles in a print-ready condition within scanning type printing systems. In general, inkjet printing systems include scanning type systems and single-pass systems. In single-pass printing systems, printheads held on a stationary carriage print images by ejecting ink across the full width of a media page as the media page continually advances underneath the carriage. In scanning type printing systems, a scanning carriage holds one or more printheads and scans the printheads across the width of a media page as the page advances underneath the carriage. The media page advances in a direction perpendicular to the direction of the scanning carriage. With each scan of the carriage across the media page, the printhead(s) prints a single swath of an image, after which the media page is advanced in a discrete increment in preparation for the next scan. With each scan across the width of the media page, printhead nozzles eject/spit ink of each different color (e.g., cyan, yellow, magenta, and black) onto the page at both ends of the print swath into designated spit bar areas according to print data from the external RIP. Spitting ink of each color at both ends of the image print swath helps to ensure that the nozzles printing the swath are not clogged or otherwise operating in a non-print-ready condition. As the image is printed swath by swath, thin spit bars of each ink color are also printed adjacent to both sides of the printed image. After the image has printed, the spit bars on either side of the image can be removed from the media page in a finishing operation.

In some printing systems, spitting is performed without considering the content of the image to be printed. For example, in some printing systems, a spit bar is printed on the sides of an image print swath for each ink color regardless of whether all the colors are to be printed within the upcoming print swath. Thus, there is no consideration of how a nozzle or set of nozzles is being operated during a print swath, and the spitting is performed independent of the ink density and color to be printed by a specific set of nozzles in an impending print swath. Unfortunately, spitting in this manner without considering upcoming image content and nozzle operation is often not efficient. For example, when a specific set of nozzles has just been used in printing an image print swath, then servicing those same nozzles by printing spit bars before printing the next image print swath is typically unwarranted. This is because printing the prior image print swath has likely already cleared or otherwise remedied any issues for the nozzles within that set of nozzles. Thus, printing the spit bars in these situations results in a wasteful ejection of printing fluids. In addition, if a specific set of nozzles is not to be operated during an upcoming print swath, it is of no immediate consequence whether those nozzles are in a print-ready condition, and printing spit bars to clear or otherwise remedy any nozzle issues within that set of nozzles results in a wasteful ejection of printing fluids.

Other methods of maintaining printhead nozzles in a print-ready condition include performing a servicing operation based on an amount of time elapsed from a previous nozzle ejection event. In this method, printing a spit bar would depend on whether the amount of time elapsed from a previous nozzle ejection event exceeds a predetermined threshold. However, this approach does not consider the image content to be printed in the next print swath, which as just noted above can result in a wasteful ejection of printing fluids.

In contrast to prior systems and methods for maintaining printhead nozzles in a print-ready condition, examples discussed herein facilitate the printing, or spitting, of "intelligent" spit bars along the sides or edges of images that help maintain printhead nozzles in a print-ready condition during printing while avoiding wasteful ejections of printing fluids. The spit bars are intelligently constructed based on an analysis and consideration of the upcoming image content to be printed. In some examples, outstanding image portions (i.e., image portions yet to be printed) are analyzed to determine whether or not to spit ink of a particular color into a portion of a corresponding spit bar along an edge of an upcoming image print swath. Thus, prior to printing an image, a determination is made on a per-swath basis as to what ink colors and which printhead nozzles are to be used in printing an upcoming print swath or plurality of print swaths. The determination can include assessments of which ink colors will be printed and which nozzles, which sets of nozzles, and/or which printheads will be used to print the ink colors. Using this and other information such as system characteristic information on decap time (i.e., the time since a nozzle has last printed or been capped), appropriate spit bars can be intelligently constructed to help ensure healthy, print-ready (e.g., unclogged) nozzles. In some examples, information about intelligently constructed spit bars is combined with "start pointer" functionality in order to facilitate printing into spit bars on a per swath basis according to the image content being printed. In some examples, additional spit bar constructions include spit bars with different combinations of inks and/or variable spit bar widths. In general, various dependencies can be considered to refine ink ejections into the intelligent spit bars, including the last time a nozzle or set of nozzles has ejected ink, and the amount of time before a nozzle or set of nozzles will eject ink.

In one example, a method of maintaining nozzles in a print-ready condition includes determining image content to be printed in an upcoming print swath, and for each ink color present within the image content, constructing an inked portion of an associated spit bar adjacent to the upcoming print swath to include the present ink color. For each ink color not present within the image content, an empty portion of an associated spit bar is constructed adjacent to the upcoming print swath.

In another example, a printer is provided to print an image by ejection of print fluids. The printer includes a controller to control construction of spit bars adjacent to image print swaths by analyzing image content within an upcoming image print swath to determine ink colors that will be printed in the upcoming image print swath. For each ink color that will be printed in the upcoming image print swath, the controller controls the construction of an inked portion of a spit bar to include the ink color.

In another example, a non-transitory processor-readable medium stores code representing instructions that when executed by a processor cause a printing system to determine from image content in an upcoming print swath, a first print fluid to be printed in the upcoming print swath. The instructions also cause the system to determine a first nozzle that will eject the first print fluid in the upcoming print swath, and prior to printing the upcoming print swath, exercise the first nozzle to eject the first print fluid onto a spit bar portion adjacent to the upcoming print swath.

As used in this document, a print swath refers to an image area printable by a printhead while being operated to print across a print media page. For example, in a single-pass printer where a carriage scans a printhead one time over the media page before the media page is advanced to print a subsequent pass, a print swath refers to the image content that is printed in a single pass of a printhead over the media page. In a multiple-pass printer where a carriage can scan a printhead multiple times over the media page before the media page is advanced to print a subsequent pass, a print swath refers to the image content that is printed in multiple passes of a printhead as it is scanned over the media page before the media page is advanced to print a subsequent pass. A spit bar refers to a narrow area at or near an edge of a print media page that is adjacent to either side of an image area of the page, onto which printing fluid drops can be "spit" (i.e., deposited or ejected) in order to help clear print nozzles and generally maintain the nozzles in a print-ready condition. While the length of a spit bar generally extends along the full length of a media page, each length portion of a spit bar adjacent to a particular print swath can be independently constructed based on the image content of the print swath.

Also as used in this document, imaging drops of a printing fluid refer to fluid drops ejected to reproduce a digital image on a substrate such as a media page. Imaging drops are ejected on a printing dot that corresponds with a pixel of the digital image to reproduce the image on the media page. Imaging drops may comprise a print fluid for color reproduction (e.g., a colored ink) or other types of print fluids such as a treatment fluid for improving print quality or durability of the printed pattern. By contrast to imaging drops, purging drops of a printing fluid refer to printing fluid drops that are ejected to clear nozzles and maintain nozzles in a print-ready condition, such as when printing or spitting ink into a spit bar at an edge of an image print swath. Purging drops may comprise the same print fluids as imaging drops. Thus, the difference between imaging drops and purging drops may not be the type of print fluid ejected, but rather, may be the manner in which they are used and/or the location on a media page where they are ejected. An "inked" portion of a spit bar refers to a portion of a spit bar that will have purging ink drops deposited on it, as contrasted to an "empty" portion of a spit bar which refers to a portion of a spit bar that will be left blank and will not have purging drops deposited on it.

FIG. 1 shows a block diagram of an example inkjet printing system 100 (i.e., printer) suitable for implementing image content based spitting of ink drops into spit bars at the edges of images on media pages to maintain printhead nozzles in a print-ready condition during printing. In this example, fluid ejection devices are implemented as fluid drop jetting printheads 114 (illustrated as printheads 114*a*-114*f*). Inkjet printing system 100 includes an inkjet printhead assembly 102, a fluid reservoir assembly 104, a mounting assembly 106, a media advance mechanism 108, an electronic printer controller 110, and a power supply 112 that provides power to the various electrical components of inkjet printing system 100. Inkjet printhead assembly 102 includes multiple printheads 114, each having at least one printhead die to eject drops of printing fluid through a plurality of orifices or nozzles 116 toward a media page 118 so as to print onto the media page 118. In some examples, a media page 118 can be a precut media sheet supplied by a media advance mechanism 108 implemented as an input media tray, and may comprise any type of suitable print medium sheet material, such as paper, card stock, transparencies, Mylar, and the like. In other examples, a media page 118 may comprise a continuous media web supplied by a roll of media from an unwinding media advance mechanism 108. Typically, nozzles 116 are arranged in columns or arrays such that properly sequenced ejection of ink from nozzles 116 causes characters, symbols, and/or other graphics or images to be printed upon a media page 118 as inkjet printhead assembly 102 and the media page 118 move relative to each other.

Fluid reservoir assembly 104 supplies printing fluids to printhead assembly 102 and includes reservoirs 120*a*-120*f* for storing the printing fluids. In one example, each fluid reservoir 120*a*-120*f* supplies fluid to a corresponding printhead 114 within printhead assembly 102. Thus, fluid reservoir 120*a* can supply fluid to printhead 114*a*, fluid reservoir 120*b* can supply fluid to printhead 114*b*, and so on. Printing fluids stored within reservoirs 120 can include different colored inks, as well as printing treatment fluids such as a pre-treatment fluid and a post-treatment fluid. In some examples, such as the example shown in FIG. 1, one printhead 114*a* can dispense a pre-treatment fluid onto a media page 118 before colored ink is applied, and another printhead 114*f* can dispense a post-treatment fluid onto the media page 118 after colored inks have been applied. Furthermore, in the example of FIG. 1, four different colored inks stored in fluid reservoirs 120*b*-120*e* and dispensed from respective printheads 114*b*-114*e*, comprise the respective ink colors of cyan, magenta, yellow, and black (CMYK). Base colors can be reproduced on a print media page 118 by depositing a drop of one of these inks onto the page. Secondary colors can also be reproduced on a print media page 118 by combining ink from different printheads. In particular, secondary or shaded colors can be reproduced by depositing drops of different base colors on adjacent dot locations of a media page 118. While four color ink reservoirs 120*b*-120*e* containing the four colors, CMYK, are discussed in the current example, other examples can include additional ink reservoirs containing additional ink colors to be deposited on a media page 118 by additional printheads. For example, a CcMmYK printing system can include additional ink reservoirs and printheads for light cyan (c) and light magenta (m).

The printing fluids in fluid reservoir assembly 104 flow from reservoirs 120 to the inkjet printhead assembly 102, and the fluid reservoir assembly 104 and inkjet printhead assembly 102 can form a one-way ink delivery system or a recirculating ink delivery system. In a one-way ink delivery system, substantially all of the printing fluid supplied to inkjet printhead assembly 102 is consumed during printing. In a recirculating ink delivery system, a portion of the printing fluid supplied to printhead assembly 102 is consumed during printing, and another portion that is not consumed is returned to the fluid reservoir assembly 104.

In one example, inkjet printhead assembly 102 and all or part of a fluid reservoir assembly 104 are housed together in a print cartridge or pen. In this case, reservoirs 120 can include local reservoirs located within the cartridge, but may also include larger reservoirs located separately from the cartridge to refill the local reservoirs through an interface connection, such as a supply tube. In another example, fluid reservoir assembly 104 is separate from inkjet printhead assembly 102 and supplies printing fluids to inkjet printhead assembly 102 through an interface connection. In either example, reservoirs 120 of fluid reservoir assembly 104 can be removed, replaced, and/or refilled.

Figure 2:
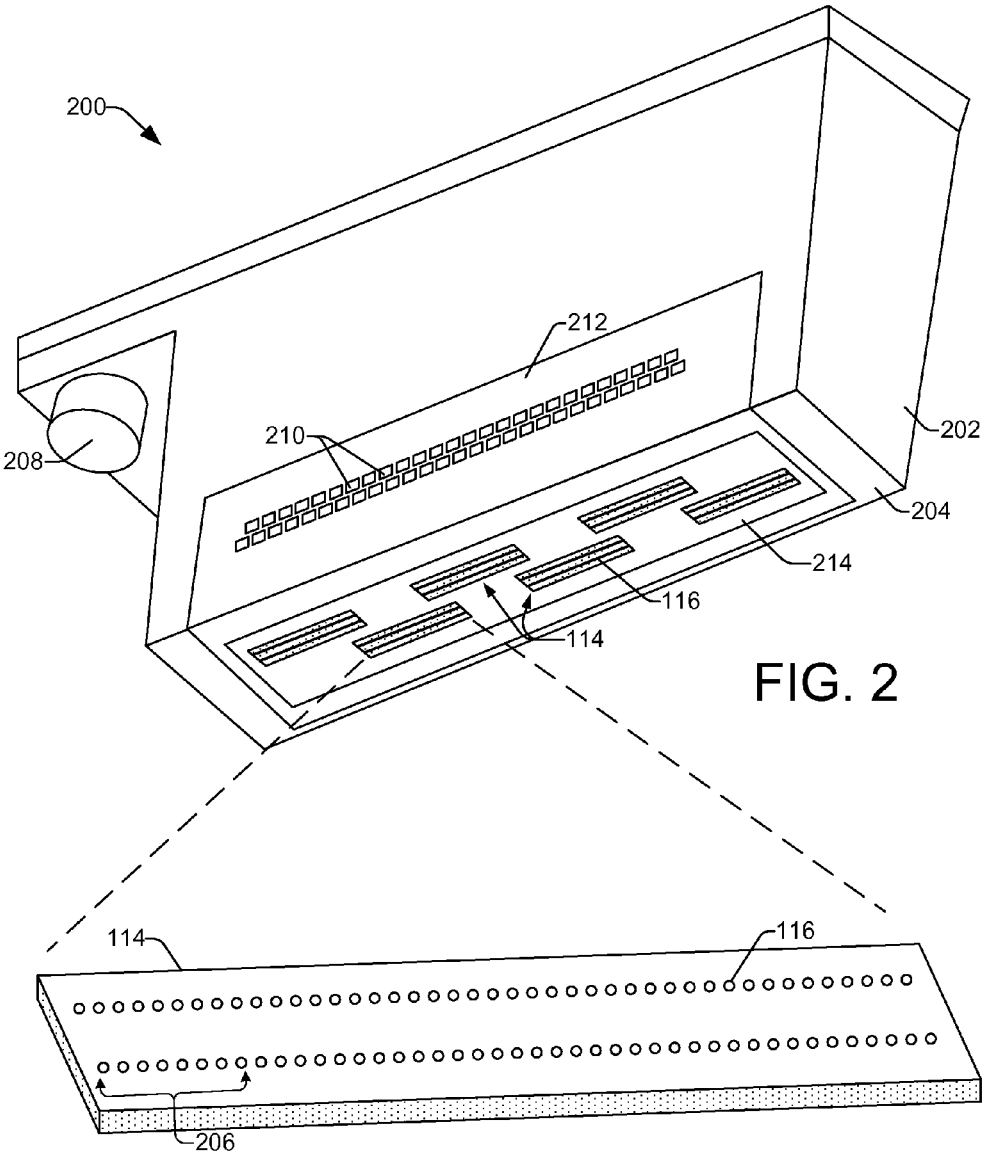
FIG. 2 shows a perspective view of an example print cartridge suitable for use within the inkjet printing system of FIG. 1.

FIG. 2 shows a perspective view of an example print cartridge 200. Referring to FIGS. 1 and 2, print cartridge 200 includes a number of printheads 114, such as printheads 114*a*-114*b*, supported by a cartridge housing 202. In this example, printheads 114 are arranged generally end to end along a length of the bottom portion 204 of the housing 202 in a staggered configuration in which one or both ends of a printhead can overlap the ends of adjacent printheads. Each printhead 114 includes a columnar array of nozzles 116 arranged generally along its length. While two columns of nozzles 116 are shown on each printhead 114, other examples of printheads 114 can include different nozzle configurations such as configurations having additional columns of nozzles. In different examples, the size, number, and pattern of nozzles 116 can vary. Nozzles 116 can be arranged into groups called primitives 206. Nozzles 116 can also be arranged into any number of multiple subsections with each subsection having a particular number of primitives 206.

Each nozzle 116 has an associated fluid drop ejection element (not shown) within the printhead 114 to eject drops of printing fluid (e.g., ink, treatment fluid) according to activation control signals from controller 110. A drop ejection element implements a fluid ejection mechanism within a fluid-filled ejection chamber to force fluid out of a nozzle 116. The fluid ejection mechanism can take on a number of different forms, such as those using thermal or piezoelectric printhead technologies. Thermal inkjet printheads eject fluid drops from a nozzle by passing electrical current through a resistive heating element to generate heat and vaporize a small portion of the fluid within a fluid-filled ejection chamber. Piezoelectric inkjet printheads use a piezoelectric material actuator to generate pressure pulses within a fluid-filled ejection chamber that force ink drops out of a nozzle.

Print cartridge 200 is fluidically connected through a fluid port 208 to a printing fluid supply, such as fluid supplies within a fluid reservoir assembly 104. Print cartridge 200 is electrically connected to controller 110 through electrical contacts 210 formed in a flex circuit 212 affixed to the cartridge housing 202. Signal traces (not shown) embedded within flex circuit 212 connect contacts 210 to corresponding contacts (not shown) on each printhead 114. Nozzles 116 on each printhead 114 are exposed through an opening 214 in the flex circuit 212 along the bottom portion 204 of the cartridge housing 202.

Figure 3:
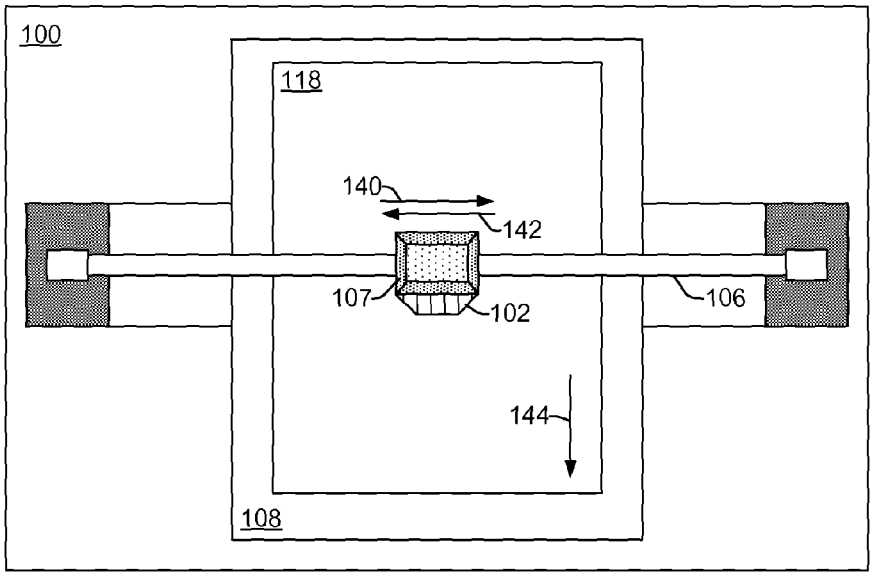
FIG. 3 shows an example of an inkjet printing system implemented as a scanning type printer.

Referring again to FIG. 1, mounting assembly 106 positions inkjet printhead assembly 102 (e.g., print cartridge 200) relative to media advance mechanism 108, and media advance mechanism 108 positions media page 118 relative to inkjet printhead assembly 102. Thus, a print zone 122 is defined adjacent to nozzles 116 in an area between inkjet printhead assembly 102 and media page 118. In one example, inkjet printing system 100 is a scanning type printer such as the printer 100 shown in FIG. 3. In a scanning type inkjet printer 100, mounting assembly 106 comprises a carriage 107 that conveys inkjet printhead assembly 102 back and forth across the width of a print media page 118 in a manner indicated by direction arrows 140 and 142. Thus, inkjet printhead assembly 102 moves in a generally horizontal manner that is orthogonal to the media advance direction 144.

Media advance mechanism 108 can include various mechanisms (not shown in FIGS. 1 and 3) that facilitate the advancement of a media page 118 through a media path of printing system 100. Such mechanisms can include, for example, input media trays for precut sheet media, unwinding devices for rolled media webs, various media advance rollers, a motor such as a DC servo motor or a stepper motor that powers the media advance rollers, and so on. In some implementations, a media advance mechanism 108 can include other mechanisms or additional mechanisms to advance a media page 118, such as a moving platform.

Referring still to FIG. 1, inkjet printing system 100 includes an electronic controller 110 to execute print jobs received from an outside source such as a host computer system (not shown). Electronic controller 110 includes a processor (CPU) 124, a memory 126, firmware, and other printer electronics for communicating with and controlling inkjet printhead assembly 102, mounting assembly 106, and media advance mechanism 108. In some examples, electronic controller 110 may also include an ASIC 125 (application specific integrated circuit) and/or additional hardware components 127 to perform certain operations of the printing system 100 alone or in combination with a processor 124 executing program instructions as discussed below. Thus, hardware components 127 can include physical components such as programmable logic arrays (PLAs), programmable logic controllers (PLCs), other logic and electronic circuits, and/or combinations of such physical components with programming executable by a processor.

Memory 126 can include both volatile (i.e., RAM) and nonvolatile (e.g., ROM, hard disk, floppy disk, CD-ROM, etc.) memory components. The memory components of a memory 126 comprise non-transitory computer/processor-readable media that provide for the storage of computer/processor-readable coded program instructions, data structures, program instruction modules, and other data for printing system 100, such as modules 130, 132, and 136. The program instructions, data structures, and modules stored in memory 126 may be part of an installation package that can be executed by processor 124 to implement various examples, such as examples discussed herein. Thus, memory 126 may be a portable medium such as a CD, DVD, or flash drive, or a memory maintained by a server from which the installation package can be downloaded and installed. In another example, the program instructions, data structures, and modules stored in memory 126 may be part of an application or applications already installed, in which case memory 126 may include integrated memory such as a hard drive. As noted, components of memory 126 comprise a non-transitory medium that does not include a propagating signal.

Electronic controller 110 can receive RIP data 128 from a host system, such as a computer, and store the data 128 in memory 126. Typically, data 128 comprises RIP (raster image processor) data that is in an appropriate image file format (e.g., a bitmap) suitable for printing by printer 100. RIP data 128 represents, for example, a document or image file to be printed. As such, RIP data 128 forms a print job for inkjet printing system 100 that includes print job commands and/or command parameters. Using RIP data 128, electronic controller 110 controls inkjet printhead assembly 102 to eject imaging fluid drops from nozzles 116. Imaging drops comprise fluid drops (e.g., ink drops) ejected to reproduce a digital image from the RIP data 128 on a media page 118. Thus, electronic controller 110 defines a pattern of ejected ink drops that form characters, symbols, and/or other graphics or images on media page 118. The pattern of ejected ink drops is determined by the print job commands and/or command parameters from RIP data 128.

In some examples, RIP data 128 also includes spit bar data 129 that defines characteristics of spit bars to be printed on a media page 118. Spit bar characteristics defined by the spit bar data 129 include spit bar page locations, spit bar sizes (i.e., thickness), and spit bar colors. Spit bars generated from spit bar data 129 are formed on a media page 118 by nozzles that spit purging fluid drops (e.g., ink drops) at defined spit bar page locations, such as locations that are adjacent to either side of a printed image. Purging fluid drops are not ejected to reproduce an intended digital image on a media page 118 from the RIP data 128, but are instead ejected onto the media page 118 in defined spit bar locations in order to clear nozzles (e.g., clear clogged nozzles) and generally maintain nozzles in a print-ready condition.

Figure 4:
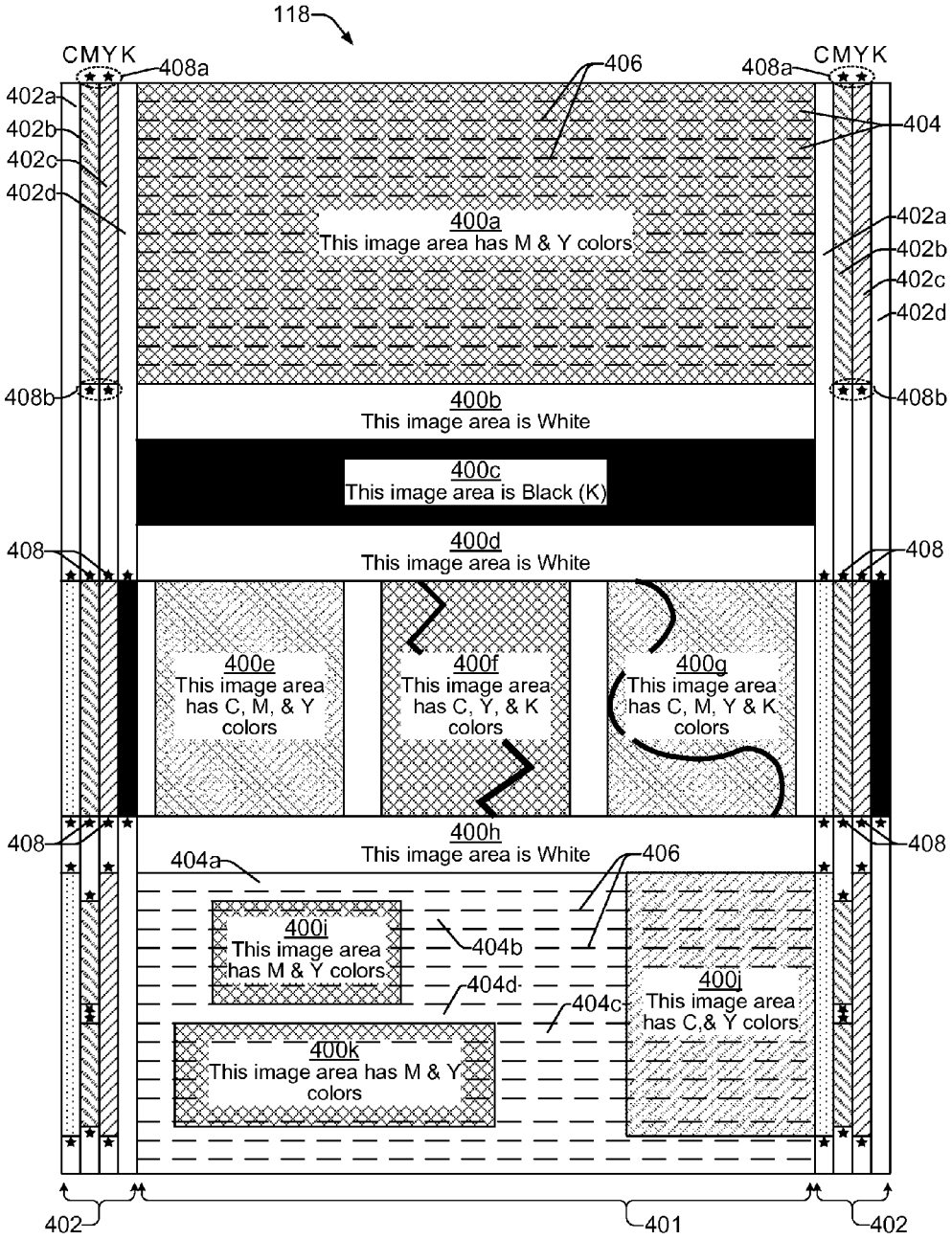
FIG. 4 shows an example of a media page printed by the example inkjet printing system of FIG. 1.

In some examples, electronic controller 110 includes an image content analysis and spit bar construction module 130 stored in memory 126. Module 130 comprises program instructions executable on processor 124 to analyze and determine upcoming image content from RIP data 128, and to prepare appropriate spit bars according to the image content that is going to be printed in upcoming print swaths. For example, as shown in FIG. 4, an example media page 118 printed by an example printer 100 includes printed images 400 (illustrated as images 400*a*-400*k*) and spit bars 402 (illustrated as spit bars 402*a*-402*d*) at or near the edges of the page 118 and extending generally along the length of the page 118. Different length portions of spit bars 402 have been constructed and printed adjacent to the printed images 400 and/or image areas 401, according to an analysis of the image content of individual print swaths within the printed images 400. In general, module 130 executes to analyze upcoming image content from the RIP data 128 and determine which ink colors are to be printed by particular nozzles 116 and/or particular groups of nozzles 116 (e.g., nozzle primitives 206) in upcoming image print swaths, such as print swaths 404. While print swaths 404 are illustrated in FIG. 4 by dashed lines 406, the dashed lines 406 are not actually printed on the media page 118 as part of an image. Instead, the dashed lines 406 should be considered as imaginary lines used merely to show differentiation between adjacent print swaths 404. Furthermore, the image print swaths 404 differentiated by imaginary dashed lines 406 are shown for the purpose of facilitating this description, and their size (i.e., swath height) is not intended to be properly to scale. In general, an image print swath 404 may be on the order of one centimeter in height, but various examples can include swath heights of greater or lesser heights. In addition, while image print swaths 404 are illustrated using imaginary dashed lines 406 in FIG. 4 with respect to images 400*a*, 400*i*, 400*j*, and 400*k*, it is to be understood that the other images 400*b*-400*h* also comprise, or are made up of, similarly differentiated image print swaths.

Referring still to FIG. 1, module 130 can analyze outstanding image portions (i.e., unprinted image portions comprising at least one print swath) of the RIP data 128 in a number of ways, including analyzing the data one print swath at a time, or multiple print swaths at a time, or one media page at a time, or one complete print job at a time, for example. However, determinations that the module 130 makes about which ink colors will be printed in the outstanding image portions and about which nozzles 116 or groups of nozzles will be used, are made on a per swath basis. In other words, module 130 determines on an individual print swath basis, or on a swath-by-swath basis, which ink colors are to be printed into each upcoming image print swath 404, and which nozzles 116 or groups of nozzles 116 will be used to print the ink colors.

In making determinations about which ink colors will be printed by which nozzles into outstanding image portions (e.g., unprinted print swaths), module 130 may access a counting function 134 provided by a density count engine 132. Density counting function 134 is to provide an estimate of the amount of each type of print fluid (e.g., amount of each ink color) to be printed in an outstanding image portion (e.g., one or multiple subsequent print swaths) by the group of nozzles for which the determination is being made (e.g., nozzles in a printhead 114 for a specific color of ink). In such examples, module 130 performs the determination based on, at least, the estimate of the amount of print fluid to be printed.

Density count engine 132 may be provided as part of an ASIC 125. Thus, density counting function 134 may be implemented as a programmed function within the ASIC 125. While one manner of implementing density count engine 132 and density counting function 134 has been discussed, there may be a variety of alternatives for implementing density count engine 132 and density counting function 134. For example, density counting function 134 may be implemented as a programmed routine in a digital signal processor (DSP). In some examples, a density counting function can be performed by a processor 124 or by a RIP (raster image processor).

The swath-by-swath ink color and nozzle determinations made by module 130 enable the module 130 to further determine an appropriate construction of the spit bars 402 to be printed adjacent and prior to each image print swath 404. Appropriately constructed spit bars 402 exercise particular nozzles 116 that will be ejecting image drops into an upcoming print swath 404 of an image 400. Therefore, nozzles that will be used to eject image drops in an upcoming image print swath 404 are exercised (i.e., actuated) over an appropriate portion of a spit bar in order to eject, or "spit", purging drops into the spit bar, which helps to clear the nozzles being used in the upcoming image print swath. For example, if the ink colors magenta and yellow are to be printed in an upcoming image print swath 404, but the colors cyan and black are not to be printed in the upcoming swath, then appropriate portions of the spit bars 402 (i.e., those portions next to the upcoming image print swath) associated with the magenta and yellow ink colors will be constructed such that magenta and yellow ink will be ejected into them prior to printing the upcoming image print swath 404, and appropriate portions of the spit bars 402 associated with the cyan and black ink colors will be constructed such that no ink will be ejected into them. Thus, based on the upcoming image content in a print swath, some portions of some spit bars can be inked (i.e., printed with purging drops), while some portions of some spit bars can be left empty or blank. In this manner, module 130 analyzes the RIP data 128 and integrates information about the upcoming image content with the RIP data 128 to construct the spit bars adjacent the various images to be printed on a media page 118.

Referring again to FIG. 4, for each upcoming print swath 404 of an image 400, adjacent portions of spit bars 402 are inked (i.e., printed) or left empty on either side of the print swath 404, based on whether or not an ink color associated with the spit bar will be ejected from nozzles 116 during printing of the upcoming print swath 404. Thus, in a printing system comprising the four base colors of CMYK (cyan, magenta, yellow, black), each one of four spit bars is associated with a particular ink color of C, M, Y, or K, as shown in FIG. 4. Particular nozzles 116 eject or spit purging drops onto a spit bar 402 that is associated with a particular ink color (i.e., by spit bar data 129), based on determinations made by module 130 about which ink colors and which nozzles will be used in the upcoming image print swath 404. Accordingly, referring to image 400*a* of FIG. 4, because each of the image print swaths 404 within image 400*a* comprises the ink colors of magenta (M) and yellow (Y), module 130 constructs the portions of spit bars 402 next to image 400*a* such that spit bar 402*b* associated with ink color M, and spit bar 402*c* associated with ink color Y, both receive purging drops of ink colors M and Y, respectively, from particular nozzles that will be printing the M and Y inks onto the upcoming image print swaths 404. The spit bars 402*a* and 402*d* associated with ink colors C and K, respectively, are constructed next to image 400*a* so that they will be empty and will not receive purging ink drops, because the colors C and K are not used in upcoming image print swaths 404 of image 400*a*. Thus, different portions of spit bars 402 are inked (i.e., printed) or left empty on either side of a print swath 404 depending on whether or not the image content of the print swath 404 includes particular ink colors associated with the spit bars 402.

Similarly, with regard to images 400*b*-400*k* of FIG. 4, adjacent portions of spit bars 402*a*-402*d* are constructed in a manner that considers whether or not the ink colors (CMYK) associated with each spit bar will be printed in the upcoming/adjacent image print swaths. For example, in images 400*b*, 400*d*, and 400*h*, the upcoming image print swaths have no ink printed in them, so they appear white because of the white media page 118. Therefore, module 130 constructs spit bars 402*a*-402*d* to be empty of ink drops, which means no ink drops will be ejected into those portions of spit bars 402*a*-402*d* adjacent to either side of the image print swaths for images 400*b*, 400*d*, and 400*h*. In effect, spit bars 402*a*-402*d* will not appear to be present in these locations that are adjacent to the image print swaths for images 400*b*, 400*d*, and 400*h*. By not spitting purging drops into spit bars 402*a*-402*d*, an inefficient and wasteful use of ink is avoided. Because there are no nozzles that will be used for image areas 400*b*, 400*d*, and 400*h*, it is irrelevant whether or not there are nozzles in a non-print-ready condition with regard to these images.

For image 400*c*, the upcoming image print swaths will be filled with all of the ink colors (CMYK) to produce the black area fill. Therefore, module 130 again constructs adjacent portions of spit bars 402*a*-402*d* so that they are empty of ink drops, and no ink drops will be ejected into those portions of spit bars 402*a*-402*d* adjacent to either side of the image print swaths for image 400*c*. The module 130 constructs the adjacent portions of spit bars 402*a*-402*d* to be empty in this situation because it is understood that printing an image area that is completely black will use all ink colors and therefore will most likely clear out any nozzles on its own. Therefore, by not spitting purging ink drops into spit bars 402*a*-402*d*, an inefficient and wasteful use of ink is again avoided.

Referring still to FIG. 4, the three images 400*e*, 400*f*, and 400*g*, are located next to each other on media page 118, and they fall within the same image print swaths across the width of the image area 401. Therefore, the image print swaths analyzed by module 130 include image content from each of the three images, and module 130 constructs adjacent portions of spit bars 402*a*-402*d* by considering the upcoming image content within each of these three images. As shown in FIG. 4, image 400*e* includes ink colors C, M, and Y; image 400*f* includes ink colors C, Y, and K; and image 400*g* includes ink colors C, M, Y, and K. Therefore, the print swaths that make up images 400*e*, 400*f*, and 400*g*, across the width of the image area 401, include all of the ink colors C, M, Y, and K. In fact, even if images 400*e* and 400*f* were not included in the image area 401 next to image 400*g*, the print swaths that make up the singular image 400*g* would still include all of the ink colors C, M, Y, and K, because image 400*g* itself includes all of the ink colors C, M, Y, and K. Because all of the ink colors are used in the image print swaths for images 400*e*, 400*f*, and 400*g*, module 130 constructs spit bars 402*a*-402*d* adjacent to these print swaths so that they are inked (i.e., printed) with purging drops of their respective ink colors. In other words, each of the spit bars 402*a*-402*d* is printed with purging drops of its associated respective ink color in the spit bar areas adjacent to image print swaths for images 400*e*, 400*f*, and 400*g*.

Images 400*i*, 400*j*, and 400*k*, of FIG. 4 are also located next to each other on media page 118, but they fall within different image print swaths across the width of the image area 401. For example, both images 400*i* and 400*k* fall within all the print swaths of image 400*j*, but image 400*j* includes additional print swaths (e.g., print swaths 404*a*, 404*d*) that fall outside of images 400*i* and 400*k*. Therefore, for images 400*i*, 400*j*, and 400*k*, the upcoming image print swaths analyzed by module 130 can include image content from image 400*j* alone (e.g., in print swaths 404*a* and 404*d*), from images 400*i*, and 400*j* (e.g., in print swath 404*b*), and from images 400*k* and 400*j* (e.g., in print swath 404*c*). In a manner similar to that discussed above, and as shown in FIG. 4, module 130 constructs spit bars 402*a*-402*d* according to the determinations made about the image content from the upcoming print swaths of images 400*i*, 400*j*, and 400*k*.

In addition to module 130 which analyzes upcoming image content and constructs spit bars based on the upcoming image content, electronic controller 110 includes a start of printing pointer module 136. Module 136 comprises program instructions executable on processor 124 to integrate the RIP data 128 with the information from module 130 (e.g., upcoming image content information on ink color and nozzle usage, and spit bar construction information). More specifically, module 136 integrates the spit bar data 129 (i.e., RIP data 128) with information from module 130 to provide start and stop points that indicate where to start ejecting purging drops into spit bars 402 and where to stop ejecting purging drops into spit bars 402. Thus, module 136 effectively modifies spit bar data 129 (i.e., RIP data 128) using the information from module 130 to avoid printing full spit bars 402 down the full length of the media page 118 along the sides of images 400. While modules 130 and 136 are illustrated (i.e., in FIG. 1) and discussed as being distinct modules, in some implementations these modules may be combined or configured differently in order to realize examples disclosed herein.

Referring to FIG. 4, the start and stop points are illustrated as small star shapes 408 (including 408*a* and 408*b*). The start and stop points 408 are not actually printed onto the media page 118. Rather, the start and stop points 408 shown in FIG. 4 are locations that indicate where the start of printing pointer module 136 has determined that purging drops should start being ejected onto each of the spit bars 402*a*-402*d*, and where purging drops should stop being ejected onto each of the spit bars 402*a*-402*d*, based on an integration of the RIP data 128 (i.e., spit bar data 129) with information from module 130 regarding the image content of the upcoming print swath and related spit bar constructions. Thus, as noted above, based on an analysis by module 130 of outstanding image content within upcoming image print swaths for image 400*a*, spit bar 402*b* and spit bar 402*c* are constructed to include purging drops of ink colors M and Y, respectively. Module 136 integrates this information with spit bar RIP data 129 to determine where printhead nozzles will start and stop printing/spitting M colored ink drops into spit bar 402*b*, and Y colored ink drops into spit bar 402*c*. As shown in FIG. 4, these start points 408*a* and stop points 408*b* coincide, respectively, with the first and last print swaths 404 of the image 400*a*.

Figure 5:
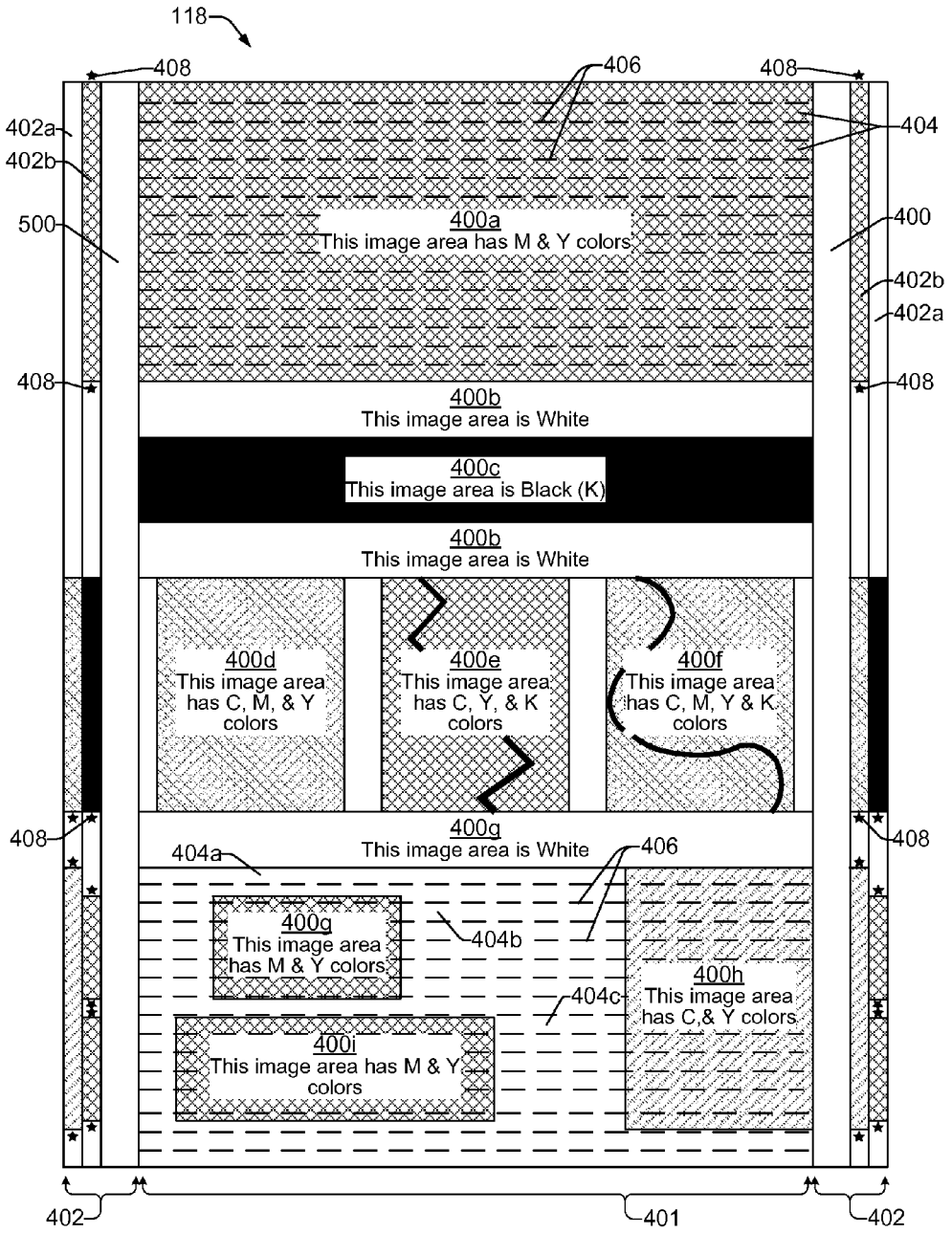
FIG. 5 shows another example of a media page printed by the example inkjet printing system of FIG. 1.

In some examples, other spit bar strategies can be applied to further reduce both the amount of ink being spit into spit bars 402 and the amount of media being used to accommodate the spit bars. FIG. 5 illustrates an example media page 118 printed by an example printer 100 implementing four base colors, CMYK. The media page 118 of FIG. 5 includes the same printed images 400 (i.e., images 400*a*-400*k*) as in the media page 118 of FIG. 4. However, the spit bars 402 shown in FIG. 5 are constructed by module 130 to include multiple ink colors instead of a single ink color. Thus, instead of having a single spit bar associated with and constructed from a single ink color, each spit bar can be associated with and constructed from multiple colors. This enables a reduction in the number of spit bars being printed adjacent to the image area 401, and thereby reduces the amount of media used to accommodate the spit bar locations.

Referring to image 400*a* of FIG. 5, as an example, module 130 analyzes upcoming print swaths 404 within image 400*a* to determine which ink colors will be printed and by which nozzles. Because the upcoming print swaths in image 400*a* include M and Y ink colors, module 130 proceeds to construct adjacent portions of spit bars to purge particular nozzles that will be ejecting the M and Y ink colors onto the upcoming print swaths. However, instead of constructing two different spit bars, one for the M ink color and one for the Y ink color, module 130 constructs a single spit bar 402*b* that includes both the M and Y ink colors. Thus, spit bar 402*b* adjacent the image 400*a* is constructed to receive both the M and Y ink colors to be printed in the upcoming print swaths of image 400*a*. A portion of spit bar 402*a* adjacent image 400*a* is constructed to be empty, or to receive no ink, because no other ink colors will be printed on the upcoming print swaths of image 400*a*. The blank media strips 500 in FIG. 5 illustrate an additional amount of print media that is available for printing images due to the reduction in the number of spit bars that results from constructing spit bars with multiple ink colors instead of a single ink color.

Figure 6:
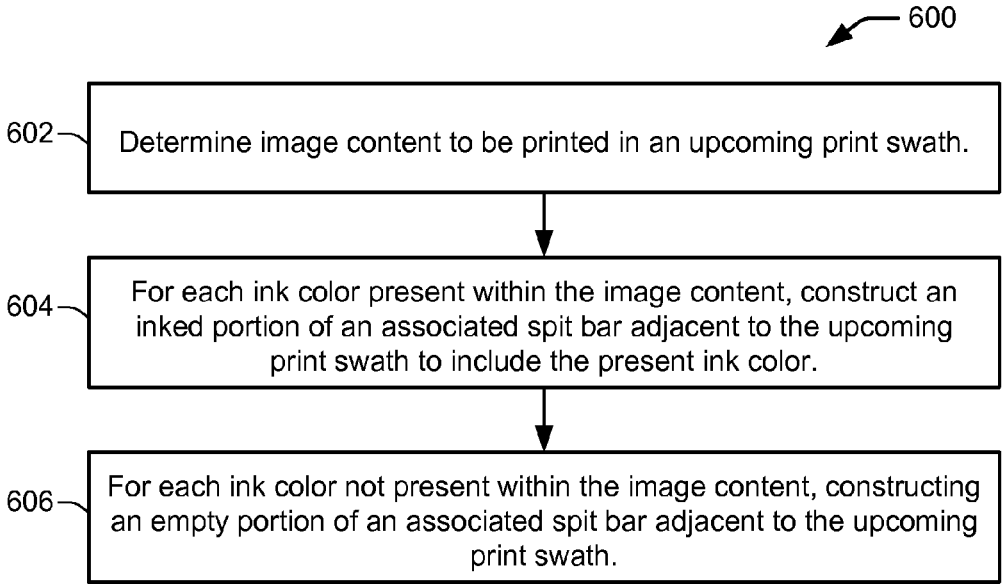
FIG. 6 shows a flow diagram that illustrates an example method of maintaining nozzles in a print-ready condition through implementing image content based ejections/spitting of ink drops into spit bars.
Figure 7:
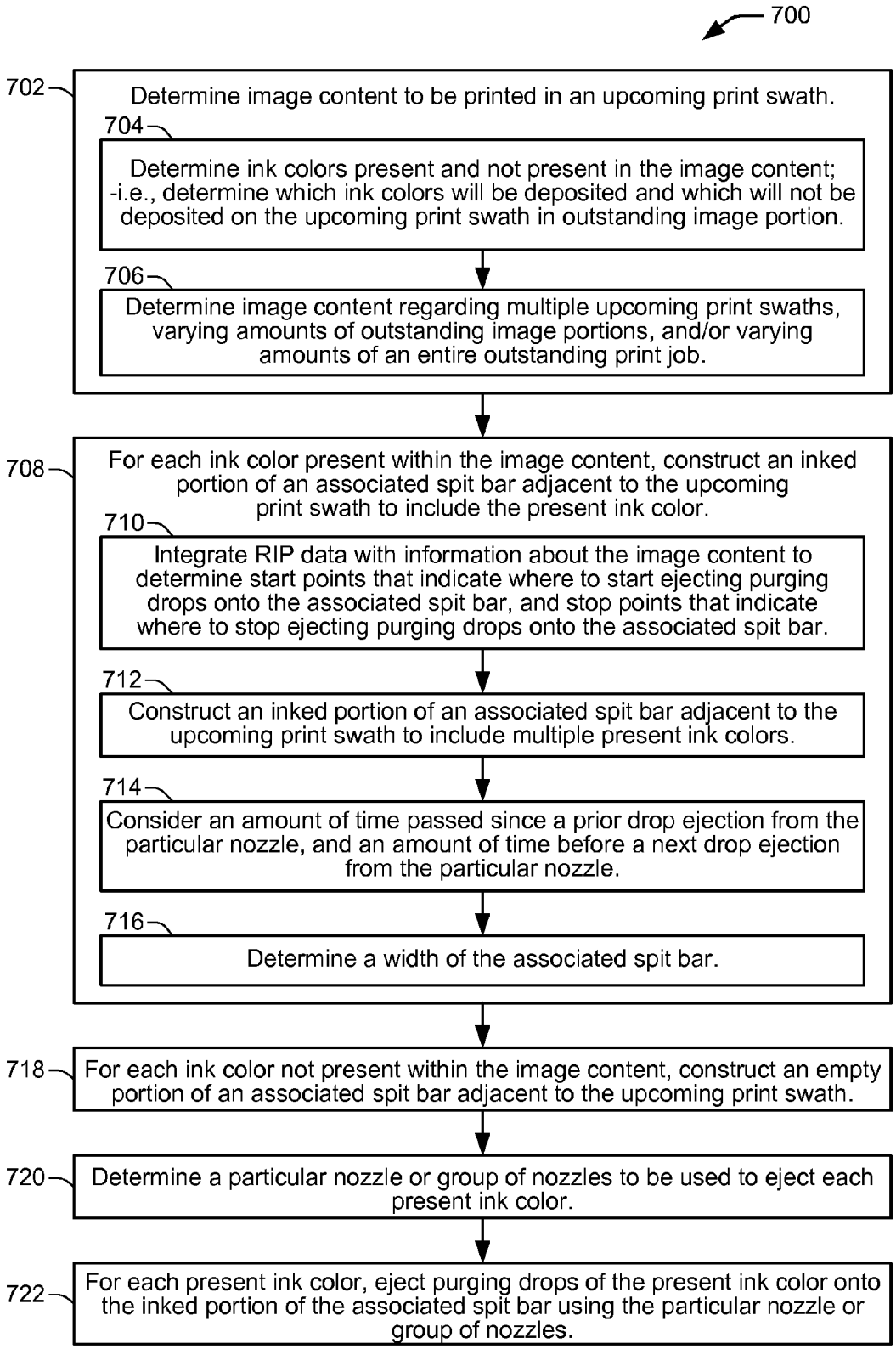
FIG. 7 shows a flow diagram that illustrates another example method of maintaining nozzles in a print-ready condition through implementing image content based ejections/spitting of ink drops into spit bars.

FIGS. 6 and 7 show flow diagrams that illustrate example methods of maintaining nozzles in a print-ready condition through implementing image content based ejections/spitting of ink drops into spit bars. Methods 600 and 700 are associated with the examples discussed above with regard to FIGS. 1-5, and details of the operations shown in methods 600 and 700 can be found in the related discussion of such examples. The operations of methods 600 and 700 may be embodied as programming instructions stored on a non-transitory computer/processor-readable medium, such as memory 126 of FIG. 1. In some examples, implementing the operations of methods 600 and 700 can be achieved by a processor such as processor 124 of FIG. 1, reading and executing the programming instructions. In some examples, implementing the operations of methods 600 and 700 can be achieved using an ASIC 125 and/or other hardware components 127 alone or in combination with programming instructions executable by a processor.

Methods 600 and 700 may include more than one implementation, and different implementations of methods 600 and 700 may not employ every operation presented in the respective flow diagrams. Therefore, while the operations of methods 600 and 700 are presented in a particular order within the flow diagrams, the order of their presentation is not intended to be a limitation as to the order in which the operations may actually be implemented, or as to whether all of the operations may be implemented. For example, one implementation of method 700 might be achieved through the performance of a number of initial operations, without performing one or more subsequent operations, while another implementation of method 700 might be achieved through the performance of all of the operations.

Referring to the flow diagram of FIG. 6, an example method 600 begins at block 602 where a first operation includes determining image content to be printed in an upcoming print swath. Determining the image content can include, for example, determining which color or colors of ink are to be deposited onto the upcoming print swath of an outstanding (i.e., unprinted) image portion, and, determining which color or colors of ink are not to be deposited onto the upcoming print swath. The example method 600 can continue at block 604 where a next operation includes, for each ink color present within the image content, constructing an inked portion of an associated spit bar adjacent to the upcoming print swath to include the present ink color. For example, if ink of the color magenta (M) is determined at block 602 to be present within the image content, then a spit bar associated with the color M through the RIP data 128 is constructed such that an inked portion of the associated spit bar is adjacent to the upcoming print swath and includes M colored ink. As shown at block 606, a next operation of method 600 includes, for each ink color not present within the image content, constructing an empty portion of an associated spit bar adjacent to the upcoming print swath. For example, where determining the image content at block 602 results in determining that ink of the color cyan (C) is not to be deposited onto the upcoming print swath, the portion of a second spit bar adjacent to the upcoming print swath associated with the cyan ink color is constructed to be empty of ink, or to not include the cyan ink.

Referring now to the flow diagram of FIG. 7, an example method 700 will be discussed in which operations are included that are in addition to, and/or are an alternative to, some of the operations of method 600. The example method 700 begins at block 702 where a first operation includes determining image content to be printed in an upcoming print swath. As shown at block 704, determining the image content can include, for example, determining which ink colors are present and which are not present within the image content. This determines which colors of ink will be deposited onto the upcoming print swath of an outstanding (i.e., unprinted) image portion, and which colors of ink will not be deposited onto the upcoming print swath. In some examples, as shown at block 706, determining the image content can include determining image content with regard to a plurality of upcoming print swaths, including varying amounts of outstanding (i.e., unprinted) image portions on a media page 118, and/or varying amounts of an entire outstanding print job.

The example method 700 continues at block 708, with, for each ink color determined to be present within the image content, constructing an "inked" portion of an associated spit bar adjacent to the upcoming print swath to include the present ink color. An inked portion refers a portion of a spit bar that will have purging ink drops deposited on it, as contrasted to an empty portion of a spit bar that will be left blank and will not have purging drops deposited on it. As shown at block 710, constructing an inked portion of an associated spit bar can include integrating RIP (raster image processor) data with information determined about the image content in order to determine start points and stop points. Start points indicate where to start ejecting purging drops onto the associated spit bar, and stop points indicate where to stop ejecting purging drops onto the associated spit bar. As shown at block 712, constructing an inked portion of an associated spit bar can include constructing the inked portion such that it includes multiple present ink colors. Thus, where determining image content in block 702 includes determining that multiple colors will be printed in an upcoming print swath, a spit bar can be constructed such that an inked portion of the spit bar includes more than one of the multiple colors. As shown at blocks 714 and 716, constructing an inked portion of an associated spit bar can include, respectively, considering the amounts of time since a prior drop ejection and before a next drop ejection from the particular nozzle, and determining a width of the associated spit bar and. Considering the time since a prior drop ejection and the time before a next drop ejection can be used to vary certain characteristics of the inked portion of the spit bar being constructed to achieve better nozzle clearing result. These spit bar characteristics can include, for example, the width of the spit bar, the density with which purging drops should be spit onto the spit bar, and so on.

The example method 700 continues at block 718, with, for each ink color not present within the image content, constructing an empty portion of an associated spit bar adjacent to the upcoming print swath. Thus, where determining image content in block 702 includes determining that certain ink colors will not be printed on an upcoming print swath, an empty portion of the spit bar can be constructed to be adjacent to the upcoming print swath. The empty portion of the spit bar will be left blank, with no purging drops being spit or deposited on it. Continuing with the example method 700, as shown at block 720, the example method 700 can include determining a particular nozzle or group of nozzles that will be used to eject each present ink color onto the upcoming print swath. At block 722, the method 700 continues with, for each ink color present within the image content of the upcoming print swath, ejecting purging drops of the present ink color onto the inked portion of the associated spit bar using the particular nozzle or group of nozzles. Thus, by analyzing the image content of upcoming print swaths, appropriate nozzles are exercised to eject upcoming ink colors onto portions of spit bars in order to put the appropriate nozzles in a print-ready condition prior to their use in printing the upcoming print swaths.

What is claimed is:

1. A method of maintaining nozzles in a print-ready condition, the method comprising:

determining image content to be printed in an upcoming print swath;

for each ink color present within the image content, constructing an inked portion of an associated spit bar adjacent to the upcoming print swath to include the present ink color; and for each ink color not present within the image content, constructing an empty portion of an associated spit bar adjacent to the upcoming print swath.

2. A method as in claim 1, further comprising determining a particular nozzle to be used to eject each present ink color.

3. A method as in claim 2, further comprising, for each present ink color, ejecting purging drops of the present ink color onto the inked portion of the associated spit bar using the particular nozzle.

4. A method as in claim 2, wherein determining a particular nozzle to be used to eject each present ink color comprises determining a group of nozzles to be used to eject each present ink color.

5. A method as in claim 1, wherein constructing an inked portion of an associated spit bar comprises integrating RIP (raster image processor) data with information about the image content to determine start points that indicate where to start ejecting purging drops onto the associated spit bar, and stop points that indicate where to stop ejecting purging drops onto the associated spit bar.

6. A method as in claim 1, wherein constructing an inked portion of an associated spit bar adjacent to the upcoming print swath to include the present ink color comprises constructing an inked portion of an associated spit bar adjacent to the upcoming print swath to include multiple present ink colors.

7. A method as in claim 1, wherein constructing an inked portion of an associated spit bar comprises determining a width of the associated spit bar.

8. A method as in claim 2, wherein constructing an inked portion of an associated spit bar comprises:

considering an amount of time passed since a prior drop ejection from the particular nozzle; and considering an amount of time before a next drop ejection from the particular nozzle.

9. A printer to print an image by ejection of print fluids, the printer comprising:

a controller to control construction of spit bars adjacent to image print swaths by:

analyzing image content within an upcoming image print swath to determine ink colors that will be printed in the upcoming image print swath; and, for each ink color that will be printed in the upcoming image print swath, constructing an inked portion of a spit bar to include the ink color.

10. A printer as in claim 9, wherein the controller is to additionally control construction of spit bars adjacent to image print swaths by:

for each ink color that will not be printed in the upcoming image print swath, constructing an empty portion of a spit bar to include no ink.

11. A printer as in claim 9, further comprising:

a density count engine associated with the controller to provide a fluid density count function for providing an estimate of an amount of each ink color to be printed in the upcoming image print swath by nozzles to be printing the upcoming image print swath.

12. A printer as in claim 11, further comprising:

an ASIC (application specific integrated circuit) associated with the density count engine and customized to provide the fluid density count function.

13. A non-transitory processor-readable medium storing code representing instructions that when executed by a processor cause a printing system to:

determine from image content in an upcoming print swath, a first print fluid to be printed in the upcoming print swath;

determine a first nozzle that will eject the first print fluid in the upcoming print swath; and prior to printing the upcoming print swath, exercise the first nozzle to eject the first print fluid onto a spit bar portion adjacent to the upcoming print swath.

14. A medium as in claim 13, the instructions further causing the printing system to:

determine from the image content, a second print fluid that will not be printed in the upcoming print swath; and prior to printing the upcoming print swath, leaving empty a portion of a spit bar associated with the second print fluid.

15. A medium as in claim 13, the instructions further causing the printing system to:

determine from the image content, a second print fluid to be printed in the upcoming print swath;

determine a second nozzle that will eject the second print fluid in the upcoming print swath; and prior to printing the upcoming print swath, exercise the second nozzle to eject the second print fluid onto the spit bar portion adjacent to the upcoming print swath, such that both the first and second print fluids are ejected onto a same spit bar portion.

* * * * *